United States Patent [19]

Kyre et al.

[11] Patent Number: 4,974,834

[45] Date of Patent: Dec. 4, 1990

[54] SAW EXERCISE BOX

[75] Inventors: Martin T. Kyre; Joan R. Kyre, both of Lubbock, Tex.

[73] Assignee: Magic Box, Inc., Lubbock, Tex.

[21] Appl. No.: 250,906

[22] Filed: Sep. 29, 1988

[51] Int. Cl.[5] ..... A63B 23/00

[52] U.S. Cl. ..... 272/93; 272/32; 434/62

[58] Field of Search ..... 272/132, 93, 131; 434/62, 219, 260; 446/144, 145

[56] References Cited

U.S. PATENT DOCUMENTS 3,295,847 1/1967 Matt ..... 272/96
4,471,957 9/1984 Engalitcheff ..... 272/132

FOREIGN PATENT DOCUMENTS 0241221 7/1946 France ..... 446/145

OTHER PUBLICATIONS

Disston saw, tool and file manual, 1942, p. 11 TJ 1195 D5, Copy located in Scientific Library.

*Primary Examiner*—Stephen R. Crow
*Attorney, Agent, or Firm*—Wendell Coffee

[57] ABSTRACT

An exercise device includes a shoe having a wooden sole resting upon a wooden base plate. A backsaw handle is attached to the shoe. Therefore, stroking the handle causes the shoe to reciprocate upon the base plate providing a satisfying sound of the wooden shoe rubbing on the wooden base plate. A heel notch on the top of the shoe provides means for stroking the shoe with the foot. The weight of the shoe may be increased by placing weight straps in a tray upon the shoe. In a second embodiment the shoe includes a backsaw and miter box. The base plate forms the bottom of a box which encloses the shoe.

1 Claim, 3 Drawing Sheets

SAW EXERCISE BOX

RIGHTS TO INVENTIONS UNDER FEDERAL RESEARCH:

There was no federally sponsored research and development concerning this invention.

BACKGROUND OF THE INVENTION:

(1) Field of the Invention

This invention relates to the exercise devices for physical therapy for an elderly or injured person. A physical therapist is one having ordinary skill in this art.

(2) Description of the Related Art

The benefits of exercise and bodily movement and movement of joints is recognized for elderly persons as well as those persons who are recovering from injury.

Many elderly people suffer from arthritis. In any event, it is recognized that normally any impact type exercise is detrimental to an elderly person. Also, characteristic with aging is a clinging to older, familiar objects and surroundings including feel and sound.

For the above reasons, it will be seen that chopping wood with the resulting impact would not be recommended for elderly people. Sawing wood would be recommended. For many elderly people, the feel of the saw handle in the hand would be familiar. Also, the resulting rasping would be a familiar and reassuring sound to the person.

Before this application was filed, the applicant was aware of the following United States patents:

| Inventor | U.S. Pat. No. |
|---|---|
| Schmidt | 1,418,401 |
| Feist | 2,097,273 |
| Uhl | 2,830,816 |
| Matt | 3,295,847 |
| Dalton | 3,807,730 |
| Dienner | 3,654,917 |
| Roman | 4,229,001 |
| Kaiser | 4,395,039 |
| Killen | 4,513,961 |

Applicant does not consider that these patents are pertinent but believes that the Examiner would be interested in any patent reported by an experienced patent searcher.

SUMMARY OF THE INVENTION:

(1) Progressive Contribution to the Art

This invention discloses an exercise device which, in the manual mode of operation, is reminiscent of sawing. A saw handle is mounted upon a shoe which is stroked over a wooden base plate. The reciprocation results in a smooth, nonimpact movement. The sliding of the wooden shoe against the wooden base plate produces a familiar reassuring sound. The exercise moves various joints in the body so the joints do not tend to "freeze up" as arthritic joints tend to do if there is no movement. However, the movement is neither strenuous enough and is free of impact that it does not aggravate, traumatize nor inflame the joints.

A tray is placed upon the wooden shoe so that weights may be placed in the tray to increase the force required to stroke the saw handle. However, in extreme cases, resulting either from injury or from advanced age, the weights may be removed so that little more than movement of the joints results.

It will be understood that a person may adjust his body and the movement so that not only arm and shoulder joints are moved, but also the back and the leg joints may be moved if the body is so positioned for such movement.

Likewise, a heel notch or foot support may be placed upon the shoe so that the shoe may be reciprocated upon the base plate by stroking the shoe with foot motion Also, the weights which may be put in the tray are provided in the form of lead shot in bands so that they may be strapped to the wrist or ankle to provide additional exercise in this form as well as to weight the shoe to produce additional frictional resistance to movement.

Also, the base plate is made in the form of a box having a top so that when the box is closed and the top in place, the exercise device is in the form of a footstool or low table. This, too, provides a familiar object for the elderly person, which, unlike other exercise devices, does not constantly remind the person that he no longer receives his exercise by labors as he did during his earlier years, but now is forced to use "artificial" devices to obtain the needed movement for his deteriorating joints.

Thereby, the total results of the invention is to provide an exercise devices which is comforting and familiar to either the injured or handicapped person or the aging person, and it is not disturbing to the person, either when in use or when in storage.

(2) Objects of this Invention

An object of this invention is to provide exercise for elderly or injured persons.

Further objects are to achieve the above with devices that are sturdy, compact, durable, lightweight, simple, safe, efficient, versatile, ecologically compatible, energy conserving, and reliable, yet inexpensive and easy to manufacture, adjust, operate and maintain.

Other objects are to achieve the above with a method that is rapid, versatile, ecologically compatible, energy conserving, efficient, and inexpensive, and does not require skilled people to adjust, operate, and maintain.

The specific nature of the invention, as well as other objects, uses, and advantages thereof, will clearly appear from the following description and from the accompanying drawing, the different views of which are not scale drawings.

Figure 1:
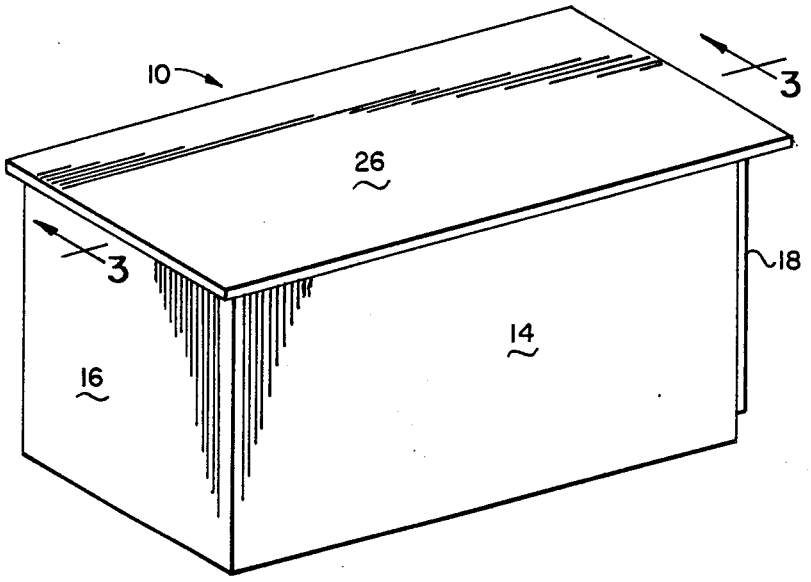
FIG. 1 is a perspective view of the box in the closed position.
Figure 2:
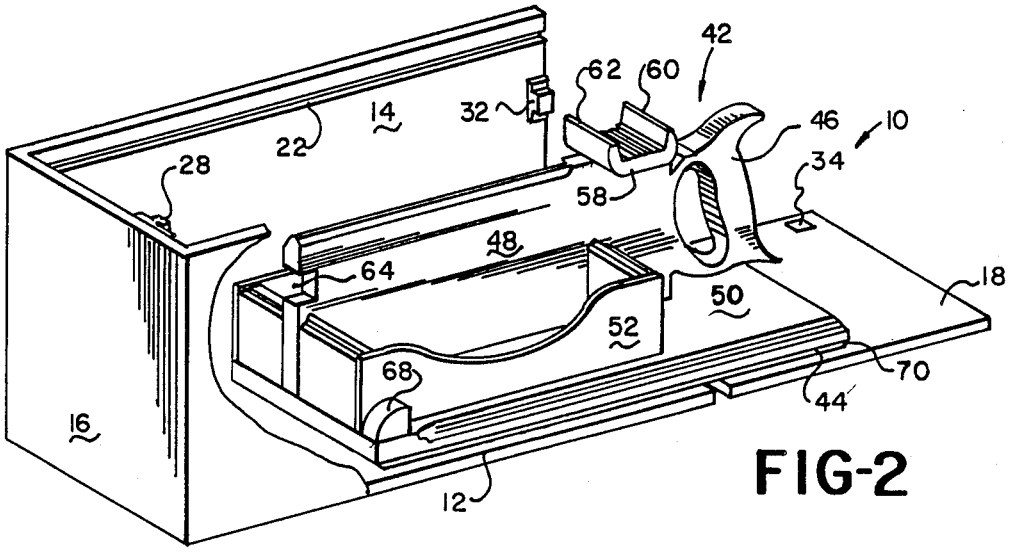
FIG. 2 is a perspective view of the box with the top panel removed, one side broken away for clarity, and the shoe in an intermediate position.
Figure 3:
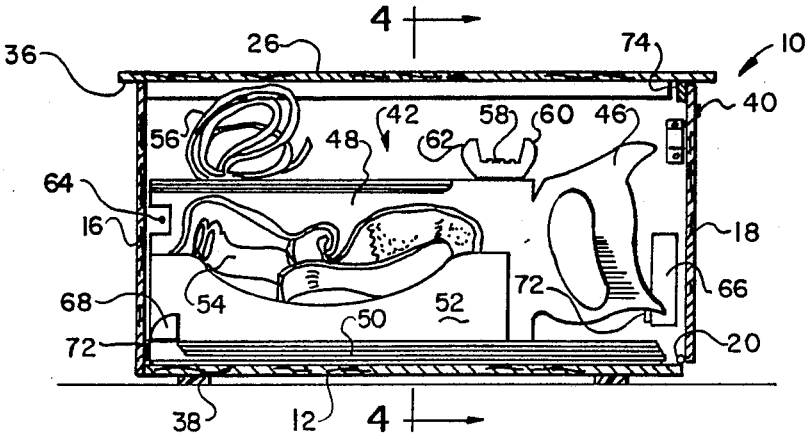
FIG. 3 is a longitudinal section of the shoe in the box with the top on and the hinged end panel closed, taken substantially along line 3—3 of FIG. 1.
Figure 4:
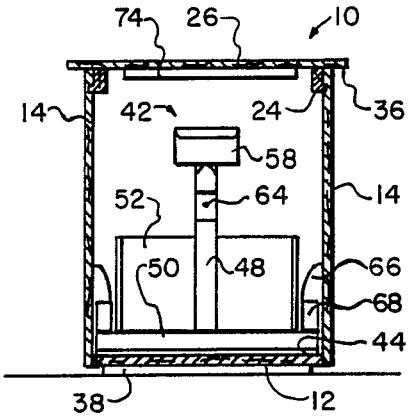
FIG. 4 is a cross section of the shoe in the box taken substantially along line 4—4 of FIG. 3.
Figure 5:
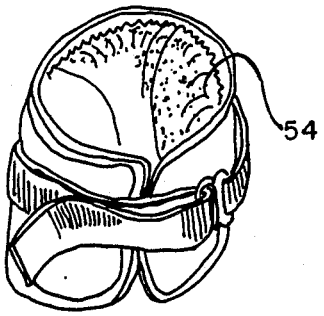
FIG. 5 is a perspective view of one of the weight bands in the buckled condition.
Figure 6:
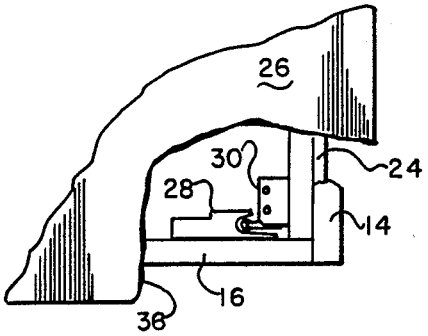
FIG. 6 is a detailed top plan view of the latch on the closed end with the top broken away.

As an aid to correlating the terms of the claims to the exemplary drawing, the following catalog of elements and steps is provided:

10 box
12 base plate
14 side panel
16 closed end
18 hinged end
20 hinge
22 groove
24 tongue
26 top
28 latch
30 top latch
32 magnetic
34 plate
36 ledge
38 nonskid strips
40 nonskid strips
42 shoe
44 sole
46 handle
48 replica
50 slide platform
52 tray
54 weight
56 cord
58 heel notch
60 forward flange
62 rear flange
64 finger hole
66 side stop
68 shoe stop
70 bevel
72 bumpers
74 lid pull
142 shoe
146 handle
148 backsaw
150 slide platform
152 miter box
158 heel notch

DESCRIPTION OF THE PREFERRED EMBODIMENT:

Referring to the drawings, there may be seen box 10. The box will include a bottom panel or wooden base plate 12. Two side panels 14 are attached to the base plate 12. Closed end plate 16 closes one end while hinged end panel 18 closes the other. The hinged end panel is hinged to the base plate by piano hinge 20.

Groove 22 at the top on the inside of each side panel mates with lid guides or tongue 24 attached to the underside of the lid or top panel 26.

Catch or latch 28 is mounted on the inside of the closed end panel 16. It cooperates with the other half of the top latch 30 so that when the lid is closed, it latches the lid in place so it will not accidentally slide open. However, the lid may be pushed against the latch; therefore, freeing it to slide open. Such latches are well known and commonly used for cabinet doors.

Magnetic holder 32 on the inside of one of the side panels 14 near the top and the hinged end panel cooperates with plate 34 upon the hinged end panel to hold the hinged end panel closed.

The box, as measured by the sides, is about 10″ wide, 10″ high, and 20″ long. The top 26 projects over the sides and the ends approximately $\frac{3}{4}$″ and forms overhang or ledge 36. This provides not only an aesthetically pleasing appearance, but also provides a convenient grip so that the box may be lifted by placing the fingertips under the overhang or ledge 36 when the top panel 26 is in place.

So that the base plate 12 does not scratch table tops or the like and also so that it is stable in use, nonskid strips 38 are placed upon the bottom of the base plate 12. Also, a single strip 40 is placed near the outside top of the hinged end panel 18. When the hinged end panel is down, the nonskid strip 40 will rest upon the same supporting surface as the base plate.

Shoe 42 is mounted within the box 10, resting upon the base plate 12. The shoe includes a friction board or wooden sole 44 which has the same dimensions as the inside dimensions of the base plate 12 with clearance. The sole 44 has approximately 1/32″ clearance between the sides 14. i.e., when the sole is against one side, it will be 1/16″ from the other side. Therefore, the bottom of the sides 14 form a portion of guide means on the base plate 12 for guiding the shoe 42 with its sole 44 on the base plate. The shoe has about $\frac{1}{8}$″ clearance from end to end. I.e., when the shoe is against the closed end panel 16, it is about $\frac{1}{4}$″ from the sides at the hinged end 18.

Handle 46 is attached to the shoe 42. The handle is located adjacent to the hinged end panel 18 of the shoe. The handle is either the handle of a carpenter's backsaw or a replica thereof.

In the embodiment shown in FIGS. 2, 3, 4, 8, and 9, the handle 42 is a portion of replica 48 of a backsaw. I.e., it is a rectangular board, the bottom edge which would be the tooth edge of a real backsaw, is resting on and attached to sliding platform 50, which is that part of the shoe to which the sole 44 is attached. Tray 52 is built upon the platform 50 and facilitates the attachment of the replica 48 to the platform. The tray also provides a convenient receptacle for weight bands 54. As explained above, normally the weight bands 54 would be in the tray 52 to increase the frictional resistance of the movement of the sole 44 upon the base plate 12. Also, the tray provides a convenient storage place for the weight bands as well as stretch rope or elastic shock cord 56. The stretch rope is also used for other exercises for the person using the box; however, it structurally has no other relationship to the box.

Foot support or heel notch 58 is attached to the top of the replica 48 adjacent to the handle 46. The heel notch is a block of wood having a notch between forward flange 60 and rear flange 62. It provides a convenient place for a person to place the heel of a shoe or the heel of the foot if no shoe is worn, to stroke or reciprocate the shoe 42 upon the base plate 12.

Finger hole 64 is cut in the replica along the face adjacent to the closed end.

Figure 9:
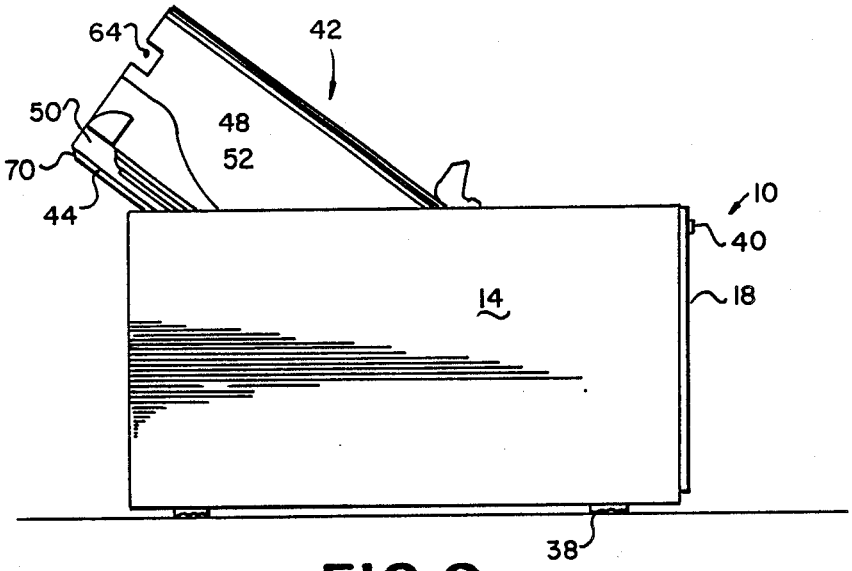
FIG. 9 is a side elevational view with the shoe in a partially removed position.

As seen in the drawings, side stops 66 are mounted on sides 14 immediately above the top surface of the sliding platform 50. Therefore, normally they hold the shoe 42 within the box 10 and prevent the shoe from bouncing against the top panel of the box. To remove the shoe from the box, a finger may be engaged in finger hole 64 and elevate the end of the shoe, and thus remove the shoe from the box (FIGS. 9 and 10).

Figure 7:
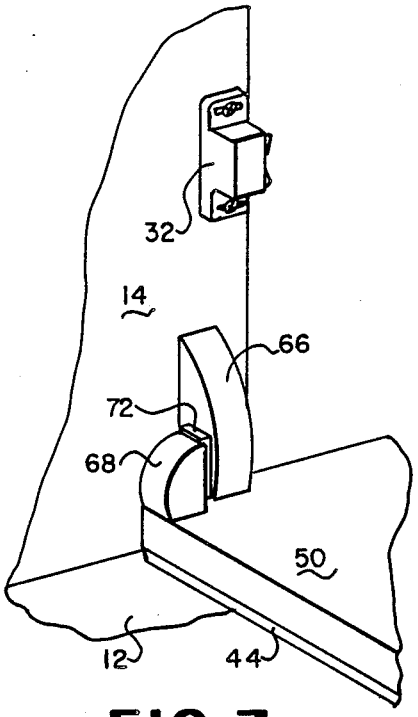
FIG. 7 is a detailed view of the position of the stops when the shoe is fully extended.
Figure 8:
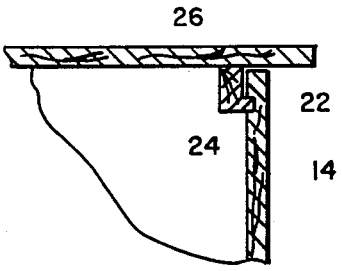
FIG. 8 is a detailed sectional view of the top panel tongue in the side panel grooves.

Shoe stop 68 is mounted upon each side of the sliding platform 50 at the rear of the platform, which is the end away from the handle 46. The shoe stop and the side stops are so constructed and arranged so that the shoe does not slide from the box when the shoe is being stroked or reciprocated upon the base plate 12 (FIG. 7).

Figure 10:
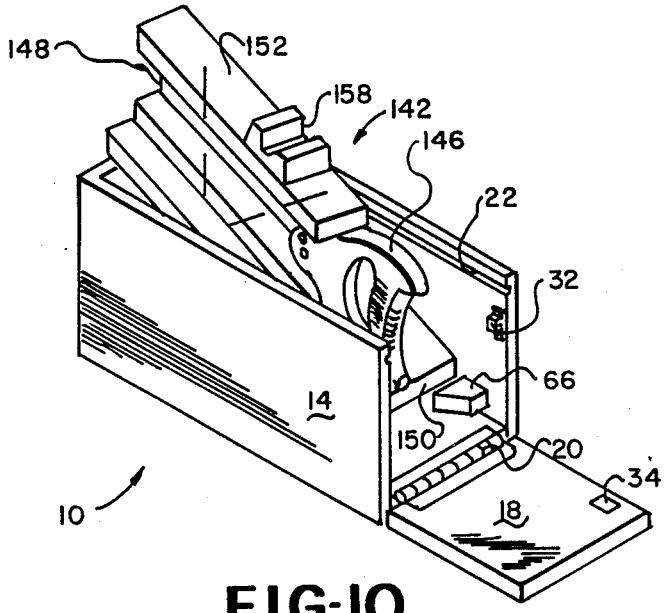
FIG. 10 is a perspective view showing a second embodiment of a shoe partially removed from the box.

In the embodiment shown in FIG. 10, it may be seen there is a shoe 142 which is very similar to the shoe 42. I.e., the shoe will have a sole, handle 146, and sliding platform 150. However, in this embodiment, there will be a real backsaw 148 attached to the handle 146. The backsaw will be attached to the bottom of miter box 152. The miter box is in turn, attached to the top of the sliding platform 150. Heel notch 158 is attached to the top of the miter box. The same unchanged box 10 is used.

It is preferred to use bolts with thumb screws to attach the saw 148 to the bottom of the miter box 152 and also to attach the miter box to the sliding platform 150 as shown in the drawing. Therefore, the thumb screws can be readily removed and the miter box removed from the sliding platform 150 and the backsaw 148 removed from the miter box, and then the saw and miter box used for cabinet making or woodworking purposes.

It will be noted that the front and the back of the sole 44 has bevel 70 for convenient stroking or sliding or reciprocation. Also, the sole is preferably attached by wood screws to the sliding platform 50 for replacement if it wears thin.

Lid pull 74 is attached to the underside of the top panel 26 adjacent to the hinged end panel 18. The lid pull 74 provides a convenient finger hold to slide the top panel 26 to remove it from the sides.

Bumpers 72 are provided at the bottom of the closed end panel and the inside surface of the side stops to prevent shock. Sponge rubber is suitable material for the bumpers 72.

The embodiment shown and described above is only exemplary. We do not claim to have invented all the parts, elements or steps described. Various modifications can be made in the construction, material, arrangement, and operation, and still be within the scope of our invention.

The restrictive description and drawing of the specific examples above do not point out what an infringement of this patent would be, but are to enable one skilled in the art to make and use the invention. The limits of the invention and the bounds of the patent protection are measured by and defined in the following claims.

I claim as my invention:

1. An exercise machine comprising:

a. a wooden base plate, b. a shoe with c. a wooden sole slideably resting on the base plate, cc. said wooden sole contacting said wooden base plate, d. a handle attached to the shoe, e. guide means on the base plate for guiding the shoe for reciprocation thereon, f. said base plate being a bottom portion of a box, g. said box having two side panels, a top panel, a hinged end panel, and a closed end panel, h. the hinged end panel hinged to the base plate, i. said handle is a backsaw handle adjacent to the hinged end panel, j. the bottom of said side panels being a portion of the guide means, k. a side stop on each side panel adjacent to the hinged end panel, l. shoe stops on the top of the shoe so constructed and arranged that the shoe stops and the side stops prevent the shoe from being sliding removed from the box when the shoe is being reciprocated upon the base plate, m. the upper portions of the side panels are grooved, n. a tongue extending on either side of the top panel engaged in said grooves so that the top panel is mounted for sliding within the grooves, o. said hinged end panel projecting above the slots so that the top panel cannot slide when the hinged end is in a closed position, and p. a latch means on the closed end panel for latching the top panel to the closed end panel.

* * * * *